US008167688B1

(12) United States Patent
Adler

(10) Patent No.: US 8,167,688 B1
(45) Date of Patent: May 1, 2012

(54) ARROW BROADHEAD CUTTING BLADE SHARPENER

(76) Inventor: Robert Lee Adler, Laurel, MT (US)

( * ) Notice: Subject to any disclaimer, the term of this patent is extended or adjusted under 35 U.S.C. 154(b) by 457 days.

(21) Appl. No.: 12/455,459

(22) Filed: Jun. 2, 2009

(51) Int. Cl.
*B24B 23/00* (2006.01)

(52) U.S. Cl. ..... 451/349; 451/524

(58) Field of Classification Search ..... 451/349, 451/520, 522, 523–525, 545, 555; 76/82, 76/86, 88
See application file for complete search history.

(56) References Cited

U.S. PATENT DOCUMENTS 3,149,506 A * 9/1964 Heinmiller ..... 76/86
3,735,542 A * 5/1973 Kocian ..... 451/461
3,819,170 A * 6/1974 Longbrake ..... 269/3
4,078,455 A * 3/1978 Brody ..... 76/88
5,054,201 A * 10/1991 Andrews ..... 30/172
5,157,879 A * 10/1992 Fletcher ..... 451/555
5,400,679 A * 3/1995 Hawker ..... 76/83
6,142,038 A * 11/2000 Kenesky et al. ..... 76/86
6,817,269 B1 * 11/2004 Grace, Jr. ..... 76/86
6,877,179 B2 * 4/2005 Marfione ..... 7/158
7,066,796 B2 * 6/2006 Pfaus ..... 451/344
7,264,540 B1 * 9/2007 Brantley ..... 451/194

* cited by examiner

*Primary Examiner* — Dung Van Nguyen
(74) *Attorney, Agent, or Firm* — Edwin H. Crabtree; Ramon L. Pizarro

(57) ABSTRACT

A handheld, arrow broadhead cutting blade sharpener used for cutting blades on an arrow broadhead, knife blades and other cutting edges. The sharpener includes a hollow handle with a first end and a second end. Included inside the first end of the handle is a first coarse stone holder with a first angled groove therein for holding a first coarse sharpening stone. The first end also includes a second coarse stone holder having a second coarse stone holder with a second angled groove therein for holding a second coarse sharpening stone. The ends of the first and second fine sharpening stones extend outwardly from the first end of the handle and are held in a "V" shaped configuration adapted for receiving an edge of a cutting blade there between. The second end of the handle includes a pair of fine sharpening stones held in a "V" shaped configuration for providing a finely sharpened edge on the cutting blade.

19 Claims, 2 Drawing Sheets

ARROW BROADHEAD CUTTING BLADE SHARPENER

BACKGROUND OF THE INVENTION (a) Field of the Invention

This invention relates to a lightweight, portable, cutting blade sharpener and more particularly, but not by way of limitation, to a handheld, arrow broadhead cutting blade sharpener for receipt in a shirt pocket and used for sharpening arrow broadhead cutting blades, knife blades and the like.

(b) Discussion of Prior Art

Heretofore, there have been a large number of patented mechanical and motor driven sharpeners for various types of cutting blades. In U.S. Pat. Nos. 7,066,796 to Pfaus, 6,817,269 to Grace, Jr., and 6,142,038 to Kenesky et al., three different types of handheld blade sharpeners are disclosed having a pair of sharpening stones held on one end of a handle. The stones are held in a "V" shaped configuration for receiving a cutting blade therebetween. In U.S. Pat. Nos. 6,877,179 to Marfione, 4,078,455 to Brody, and 3,819,170 to Longbrake, sharpeners for arrow broadheads and knife blades are described. In these patents, a file is used in combination with a handle or device for holding the blade in place as it's sharpened. In U.S. Pat. Nos. 7,264,540 to Brantley and 5,157,879 to Fletcher table mounted broadhead sharpeners are illustrated.

None of the above mentioned prior art patents specifically disclose or describe the unique features, structure and advantages of the subject handheld, arrow broadhead cutting blade sharpener as disclosed herein.

SUMMARY OF THE INVENTION

In view of the foregoing, it is a primary objective of the subject invention to provide a lightweight, handheld, cutting blade sharpener for use when bow hunting and other outdoor activities.

Another object of the invention is the sharpener is similar in size to a writing pen and can be easily carried in a shirt pocket for quick access when sharpening the cutting blades of an arrow broadhead.

Still another object of the invention is the sharpener includes an elongated handle having a pair of coarse sharpening stones mounted on one end of the handle for the initial coarse edge sharpening of a cutting blade and a pair of fine sharpening stones mounted on an opposite end of the handle for fine edge sharpening of the cutting blade.

Yet another object of the invention is the elongated handle includes a coarse knurl around the outer circumference of the one end of the handle for identifying and using the coarse sharpening stones and a fine knurl around the outer circumference of the opposite end of the handle for identifying and using the fine sharpening stones.

The subject invention includes a hollow, elongated handle with a first end and a second end. Mounted inside the first end of the handle is a first coarse stone holder with a first angled groove therein for holding a first coarse sharpening stone. The first end also includes a second coarse stone holder with a second angled groove therein for holding a second coarse sharpening stone. The ends of the first and second coarse sharpening stones extend outwardly from the first end of the handle and are held in a "V" shaped configuration adapted for receiving a cutting blade and providing a coarse sharpened edge thereon. Mounted inside the second end of the handle is a first fine stone holder with a first angled groove therein for holding a first fine sharpening stone. The second end also includes a second fine stone holder with a second angled groove therein for holding a second fine sharpening stone. The ends of the first and second fine sharpening stones extend outwardly from the second end of the handle and are held in a "V" shaped configuration adapted for receiving the cutting blade edge and providing a fine sharpened edge thereon.

These and other objects of the present invention will become apparent to those familiar with arrow broadhead cutting blade sharpeners when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the subject blade sharpener and in which:

FIG. 4 is a perspective view of the coarse sharpening stones with the ends of the stones beveled forming a "V" shaped configuration for receiving a cutting blade there between.

DETAILED DESCRIPTION OF THE PREFERRED EMBODIMENTS

Figure 1:
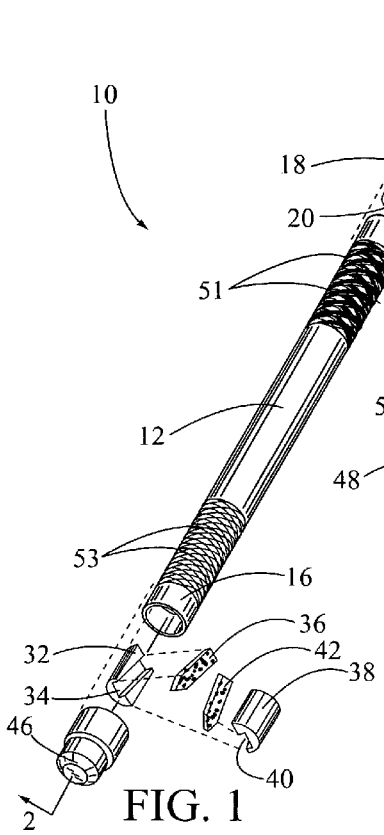
FIG. 1 is an exploded view of the elements making up the subject arrow broadhead cutting blade sharpener.

In FIG. 1, the subject arrow broadhead cutting blade sharpener is shown having a general reference numeral 10. The sharpener 10 includes a hollow, elongated round handle 12 with a first end 14 and a second end 16. The handle 12 has a length of approximately 114 mm, an outer diameter of approximately 9.5 mm and an inner diameter of approximately 6.4 mm.

Figure 5:
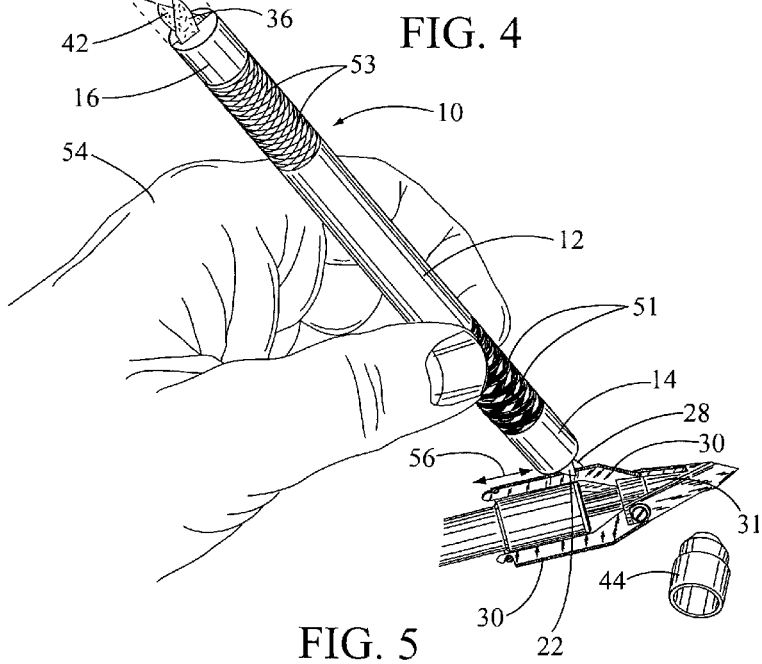
FIG. 5 is a perspective view of a human hand holding the first end of the handle and the coarse sharpening stones engaging an edge of one of the cutting blades mounted on an arrow broadhead.

Positioned for mounting inside the first end 14 of the handle 12 is a first coarse stone holder 18 with a first angled groove 20 therein for holding a first coarse sharpening stone 22. Also, the first end 14 is positioned for receiving a second coarse stone holder 24 with a second angled groove 26 therein for holding a second coarse sharpening stone 28. The ends of the first and second coarse sharpening stones 22 and 28 extend outwardly from the first end 14 of the handle 12 and are held in a "V" shaped configuration adapted for receiving a cutting blade 30 of an arrow broadhead 31 and providing a coarse sharpened edge thereon. The cutting blade 30 and broadhead 31 are shown in FIG. 5.

Also in this drawing, the second end 16 of the handle 12 is positioned for mounting a fine stone holder 32 with a first angled groove 34 therein for holding a first fine sharpening stone 36. Also, the second end 16 receives a second fine stone holder 38 with a second angled groove 40 therein for holding a second fine sharpening stone 42. The ends of the first and second fine sharpening stones 36 and 42 extend outwardly from the second end 16 of the handle 12 and are held in a "V" shaped configuration adapted for receiving the cutting blade 30 therebetween and providing a fine sharpening edge thereon. The stone holders, described above, are received inside the first and second ends 14 and 16 of the hollow handle 12 in a press fit.

The cutting blade sharpener 10 further includes a first end cap 44 and a second end cap 46, which are received around an outer circumference of the first end 14 and second end 16 in a press fit or threaded thereon. The end caps 44 and 46 are used for protecting the sharpening stones when not in use. Also, a pocket clip 48 with semi-circular base 50 is shown for receipt around a portion of the handle 12 and used for holding the sharpener 10 inside a shirt pocket. Further, the first end 14 of the handle includes a coarse, knurl surface 51, used to identify quickly the coarse sharpening stones 22 and 28 and the second end 16 including a fine, knurl surface 53, used to identify the fine sharpening stones 36 and 42.

Figure 2:
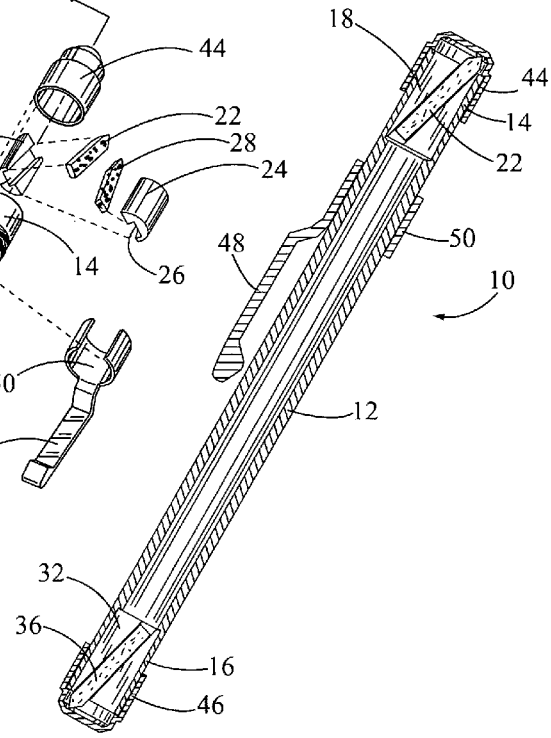
FIG. 2 is a side sectional view of an elongated hollow handle taken along lines 2-2, shown in FIG. 1, and including stone holders and sharpening stones mounted in opposite ends of the handle and end caps.

In FIG. 2, a side sectional view of the elongated hollow handle 12 is shown taken along lines 2-2. In this drawing, the stone holders 18 and 32 and sharpening stones 22 and 36 are shown mounted in the first and second ends 14 and 16 of the handle 12. Also, the end caps 44 and 46 are shown in cross section and mounted on the first and second ends 14 and 16 for protecting the ends of the sharpening stones. Further, the clip 48 and base 50 are shown in cross section mounted on the handle 12.

Figure 3:
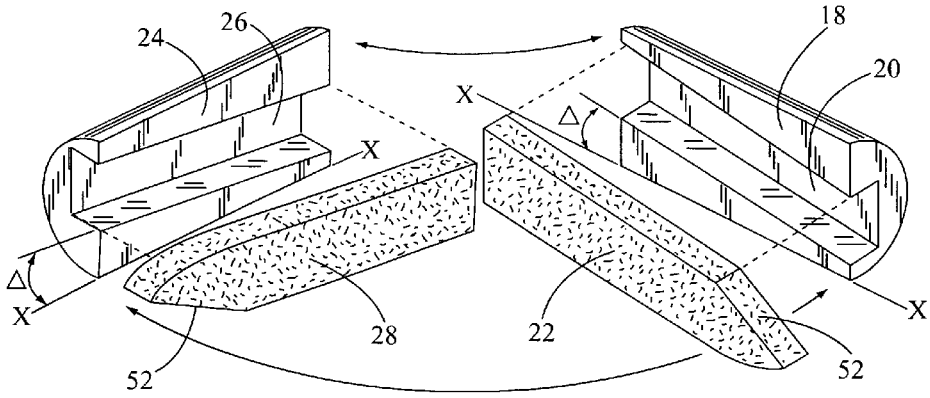
FIG. 3 is a perspective view of a pair of coarse stone holders with angled grooves therein for holding a pair of coarse sharpening stones.

In FIG. 3, a perspective view of the first and second coarse stone holders 18 and 24 are shown with angled grooves 20 and 26 therein for holding the first and second coarse sharpening stones 22 and 28 in a "V" shaped configuration. The first coarse stone holder 18 is similar in size and shape to the second coarse stone holder 24 except the angled groove 20 extends downwardly from a horizontal axis X-X at an angle "A" delta in a range of 4 to 12 degrees and more specifically at an angle of 8 degrees. In the second coarse stone holder 18, the angled groove 26 extends upwardly from the horizontal axis X-X at an angle "A" delta of approximately 8 degrees. Therefore, the length of the two stones 22 and 28 are held at an angle of approximately 16 degrees to each other. The two fine stone holders 32 and 38 are similar to in size and shape to the two coarse stone holders 18 and 24 and the two fine sharpening stones 36 and 42 are also held at a similar angle to each other for providing the "V" shaped configuration at the ends of the fine sharpening stones.

Figure 4:
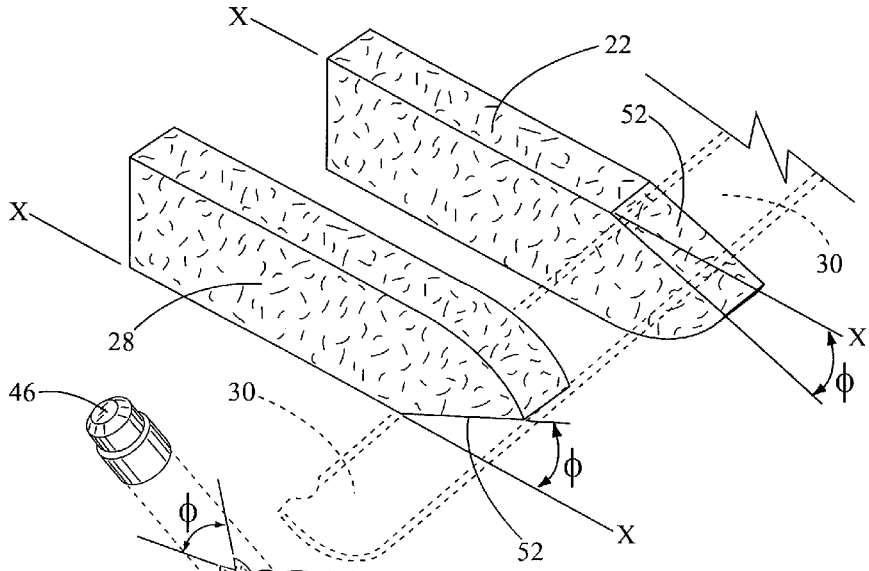

In FIG. 4, a perspective view of the two coarse sharpening stones 22 and 28 are shown with the ends of the stones 22 and 28 having a beveled surface 52. The beveled surface 52 is at an angle "Φ" phi, which is approximately 19 degrees from the horizontal axis X-X. The two fine sharpening stones 32 and 42 also include a beveled surface 52 at an angle "Φ" phi. With the two coarse and the two fine sharpening stones mounted at angles to each other in the angled grooves and with beveled surface 52, the "V" shaped configuration is in a range of 50 to 60 degrees and more specifically approximately 54 degrees for receiving the cutting blade 30 there between, as shown in FIG. 5. In this drawing the blade 30 is shown in dashed lines.

In FIG. 5, a perspective view of a human hand 54 is shown holding the first end 14 of the handle 12. In this drawing, the hand 54 is moving the coarse sharpening stones 22 and 28 back and forth, as indicated by arrow 56, and engaging the edge of one of the cutting blades 30 mounted on the arrow broadhead 31. When the coarse sharpening of the cutting blade is completed, the handle 12 can be quickly turned around and the fine sharpening stones 36 and 42 can be used for the fine sharpening of the cutting blade.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A handheld, arrow broadhead cutting blade sharpener used for sharpening cutting blades on an arrow broadhead, knife blades and other cutting edges, the blade sharpener comprising:

an elongated handle with a first end and a second end, the first end of the handle having a first coarse stone holder mounted therein, the first coarse stone holder including a first angled groove therein for holding a first coarse sharpening stone;

the first end of the handle having a second coarse stone holder mounted therein, the second coarse stone holder including a second angled groove therein for holding a second coarse sharpening stone, the ends of the first and second coarse sharpening stones extending outwardly from the first end of the handle and held in a "V" shaped configuration, the "V" shaped configuration of the sharpening stones adapted for receiving an edge of the cutting blade there between;

the second end of the handle having a first fine stone holder mounted therein, the first fine stone holder including a first angled groove therein for holding a first fine sharpening stone; and the second end of the handle having a second fine stone holder mounted therein, the second fine stone holder including a second angled groove therein for holding a second fine sharpening stone, the ends of the first and second fine sharpening stones extending outwardly from the second end of the handle and held in a "V" shaped configuration, the "V" shaped configuration of the sharpening stones adapted for receiving an edge of the cutting blade there between.

2. The blade sharpener as described in claim 1 further including a first end cap received around an outer circumference of the first end of the handle for protecting the outwardly extending ends of the first and second coarse sharpening stones.

3. The blade sharpener as described in claim 1 further including a second end cap received around an outer circumference of the second end of the handle for protecting the outwardly extending ends of the first and second fine sharpening stones.

4. The blade sharpener as described in claim 1 further including a pocket clip attached to the handle and adapted for securing the blade sharpener inside a shirt pocket.

5. A handheld, arrow broadhead cutting blade sharpener used for sharpening cutting blades on an arrow broadhead, knife blades and other cutting edges, the blade sharpener comprising:

an elongated, hollow round handle with a first end and a second end, the first end of the handle having a first coarse stone holder mounted therein, the first coarse stone holder including a first angled groove therein for holding a first coarse sharpening stone, the first end also having a second coarse stone holder mounted therein, the second coarse stone holder including a second angled groove therein for holding a second coarse sharpening stone, the ends of the first and second coarse sharpening stones extending outwardly from the first end of the handle and held in a "V" shaped configuration, the "V" shaped configuration of the sharpening stones adapted for receiving an edge of the cutting blade there between; and the second end of the handle having a first fine stone holder mounted therein, the first fine stone holder including a first angled groove therein for holding a first fine sharpening stone, and the second end also having a second fine stone holder mounted therein, the second fine stone holder including a second angled groove therein for holding a second fine sharpening stone, the ends of the first and second fine sharpening stones extending outwardly from the second end of the handle and held in a "V" shaped configuration, the "V" shaped configuration of the sharpening stones adapted for receiving an edge of the cutting blade there between.

6. The blade sharpener as described in claim 5 further including a first end cap received around an outer circumference of the first end of the handle in a press fit or threaded thereon for protecting the outwardly extending ends of the first and second coarse sharpening stones.

7. The blade sharpener as described in claim 5 further including a second end cap received around an outer circumference of the second end of the handle in a press fit or threaded thereon for protecting the outwardly extending ends of the first and second fine sharpening stones.

8. The blade sharpener as described in claim 5 further including a pocket clip attached to an outer circumference of a portion of the handle and adapted for securing the blade sharpener inside a shirt pocket.

9. The blade sharpener as described in claim 5 wherein ends of the first and second coarse sharpening stones are held at an angle to each other in range of 50 to 60 degrees in the "V" shaped configuration for receiving the cutting blade there between.

10. The blade sharpener as described in claim 5 wherein ends of the first and second fine sharpening stones are held at an angle to each other in range of 50 to 60 degrees in the "V" shaped configuration for receiving the cutting blade there between.

11. A handheld, writing pen size, arrow broadhead cutting blade sharpener used for sharpening cutting blades on an arrow broadhead, knife blades and other cutting edges, the blade sharpener comprising:

an elongated, hollow round handle with a first end and a second end, the first end of the handle having a first coarse stone holder mounted therein in a press fit, the first coarse stone holder including a first angled groove downwardly at an angle of 8 degrees from the horizontal, the first angled groove holding a first coarse sharpening stone, the first end also having a second coarse stone holder mounted therein, the second coarse stone holder including a second angled groove upwardly at an angle of 8 degrees from the horizontal, the second angled groove holding a second coarse sharpening stone, the ends of the first and second coarse sharpening stones extending outwardly from the first end of the handle and held in a "V" shaped configuration in a range of 50 to 60 degrees, the "V" shaped configuration of the sharpening stones adapted for receiving an edge of the cutting blade there between; and the second end of the handle having a first fine stone holder mounted therein, the first fine stone holder including a first angled groove downwardly at 8 degrees from the horizontal, the first angled groove holding a first fine sharpening stone, and the second end also having a second fine stone holder mounted therein, the second fine stone holder including a second angled groove upwardly at 8 degrees from the horizontal, the second angled groove for holding a second fine sharpening stone, the ends of the first and second fine sharpening stones extending outwardly from the second end of the handle and held in a "V" shaped configuration in a range of 50 to 60 degrees, the "V" shaped configuration of the sharpening stones adapted for receiving an edge of the cutting blade there between.

12. The blade sharpener as described in claim 11 further including a first end cap received around an outer circumference of the first end of the handle in a press fit or threaded thereon for protecting the outwardly extending ends of the first and second coarse sharpening stones.

13. The blade sharpener as described in claim 11 further including a second end cap received around an outer circumference of the second end of the handle in a press fit or threaded thereon for protecting the outwardly extending ends of the first and second fine sharpening stones.

14. The blade sharpener as described in claim 11 wherein ends of the first and second coarse sharpening stones include a beveled surface.

15. The blade sharpener as described in claim 11 wherein ends of the first and second fine sharpening stones include a beveled surface.

16. The blade sharpener as described in claim 11 wherein ends of the first and second coarse sharpening stones are held at an angle of 54 degrees to each other in the "V" shaped configuration for receiving the cutting blade there between.

17. The blade sharpener as described in claim 11 wherein ends of the first and second fine sharpening stones are held at an angle of 54 degrees to each other in the "V" shaped configuration for receiving the cutting blade there between.

18. The blade sharpener as described in claim 11 wherein the first end of the handle includes a coarse knurl surface therearound for quickly identifying the coarse sharpening stones extending outwardly from the first end.

19. The blade sharpener as described in claim 11 wherein the second end of the handle includes a fine knurl surface therearound for quickly identifying the fine sharpening stones extending outwardly from the second end.

* * * * *